United States Patent [19]

Schuster

[11] Patent Number: 4,545,144

[45] Date of Patent: Oct. 8, 1985

[54] SHOOTERS TABLE

[76] Inventor: Philip C. Schuster, P.O. Box 1523, Ft. Collins, Colo. 80522

[21] Appl. No.: 399,070

[22] Filed: Jul. 16, 1982

[51] Int. Cl.[4] ..... F41C 29/00

[52] U.S. Cl. ..... 42/94; 108/27

[58] Field of Search ..... 42/94; 108/121, 27, 108/28, 5, 131, 129, 115, 59, 100; 89/37 B, 37 BA; 211/64; 312/239

[56] References Cited

U.S. PATENT DOCUMENTS

| | | | |
|---|---|---|---|
| D. 162,207 | 2/1951 | Mettenletter | 211/64 |
| 1,374,862 | 4/1921 | Peoples | 89/37 B |
| 2,121,982 | 6/1938 | Pugsley | 89/37 BA |
| 2,582,140 | 1/1952 | Leek | 89/37 BA |
| 2,598,128 | 5/1952 | Liechty | 311/2 |
| 2,729,975 | 1/1956 | Hawthorne et al. | 89/37 BA |
| 2,847,909 | 8/1958 | Kester | 89/40 |
| 2,959,295 | 11/1960 | Howard et al. | 211/64 |
| 3,068,852 | 12/1962 | Purtzer | 126/25 |
| 3,108,549 | 10/1963 | Amsler | 108/129 |
| 3,125,929 | 3/1964 | Peasley | 89/37 BA |
| 3,349,728 | 10/1967 | Barecki et al. | 108/131 |
| 3,474,743 | 10/1968 | Blevins | 108/129 |
| 3,711,984 | 1/1973 | Dyer et al. | 42/94 |
| 3,827,172 | 8/1974 | Howe | 42/94 |
| 3,863,376 | 2/1975 | Dalmaso | 42/94 |
| 3,869,106 | 3/1975 | Gregor | 108/27 |
| 4,113,107 | 9/1978 | Jaeger | 211/64 |
| 4,117,782 | 10/1978 | Cahill | 108/27 |
| 4,296,963 | 10/1981 | Blanchard et al. | 108/100 |

FOREIGN PATENT DOCUMENTS

| | | | |
|---|---|---|---|
| 51866 | 6/1912 | Fed. Rep. of Germany | 42/94 |
| 2616560 | 10/1977 | Fed. Rep. of Germany | 211/64 |
| 2063060 | 6/1981 | United Kingdom | 108/27 |

OTHER PUBLICATIONS

The American Rifleman, Apr. 1957, p. 16n.

*Primary Examiner*—Charles T. Jordan
*Attorney, Agent, or Firm*—Henderson & Sturm

[57] ABSTRACT

This invention relates to shooting benches in general, and more specifically to a collapsible, portable, contoured, shooting table with adjustable legs and having raised and recessed portions, to accommodate a shooters upper torso, support a plurality of firearms, and prevent loose shells from rolling off the table surface.

6 Claims, 3 Drawing Figures

SHOOTERS TABLE

BACKGROUND OF THE INVENTION

While collapsible support surfaces commonly referred to as "shooting benches", are well recognized by the prior art, as evidenced by U.S. Pat. Nos.: 2,847,909 and 3,711,984, these devices have not been well received by the general shooting fraternity, for a variety of reasons.

It also seems as if all of the shooting benches that are commericially available share the same deficiencies found in the patented devices; in that they are too simplistic in design and construction, to be of any use to the firearms enthusiast; or they are so bulky and complex, that they are not easily transported to the field, or virtually require an engineering degree, and/or an unlimited amount of time to assembly them properly.

As a result, most sportsmen resort to either using the hoods of their vehicles as a support, or merely lie on a ground cloth, when they want to sight in their firearms. Neither of these solutions however is acceptable; and there has been a long felt need for a compact, collapsible, shooting platform that would be suitable for use at home, or on the range, or in the field.

The present invention provides a solution to the aforementioned problems, and accomplishes it with a device, which is lightweight, adjustable, compact, contoured to accommodate the users upper torso, and is provided with other unique features, which should prove to be very popular with sportsmen.

SUMMARY OF THE INVENTION

An object of the present invention is the provision of a compact, collapsible, shooting platform or bench.

Another object of the present invention is the provision of an adjustable shooting table which is suitable for use at home, or on the range, or in the field.

Still another object of the present invention is the provision of a shooting table which is contoured to receive the upper torso of a firearms enthusiast.

Yet, another object of the present invention is to provide a shooting table, having means to retain cylindrical and spherical objects on its horizontal surface.

A further object of the present invention is to provide a shooting table, having means to support a plurality of rifles in the vertical position.

A yet further object of the present invention is the provision of a shooting table, which is lightweight, easily assembled and leveled, and can be folded and stored in a vertical position, so that it occupies very little usable space.

These and other objects, advantages, and novel features of the invention will become apparent from the detailed description which follows, when considered in conjunction with the accompanying drawings.

DETAILED DESCRIPTION OF THE PREFERRED EMBODIMENT

Figure 1:
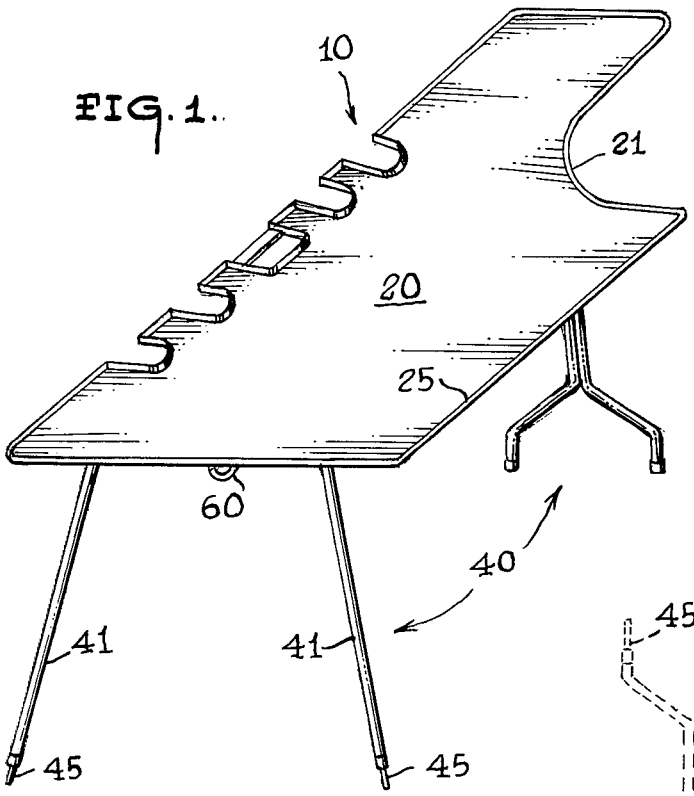
FIG. 1 is a perspective view of the shooting table which forms the basis of the present invention.

The shooting table, which forms the basis of the present invention, is designated generally as 10 in FIG. 1, and comprises a generally rectangular horizontal table surface 20, which is provided with a plurality of collapsible, pivoted, vertical support members 40.

Figure 2:
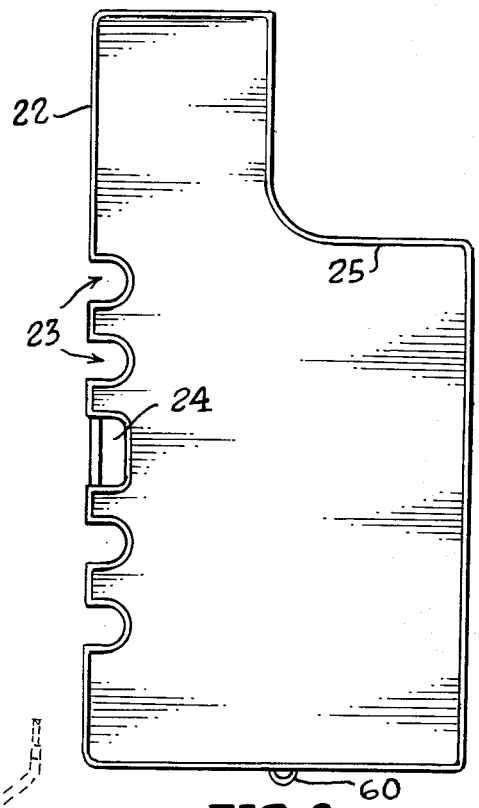
FIG. 2 is a top view of the table surface.

One of the rear corners of the table surface 20 is provided with an enlarged arcuate recess 21, which is dimensioned to receive a portion of the upper torso of a person using the shooting table, to aid in the ighting in of a pistol or rifle. As can best be seen by reference to FIG. 2, the elongated side 22 of the table, opposite the enlarged recess 21, is further provided with a plurality of smaller recess 23, and an elongated aperture 24 disposed proximate thereto.

The table surface 20 is further provided with a continuous raised portion 25, which extends around its entire periphery, except for the edge of the table immediately adjacent the elongated aperture 24, wherein the continuous raised portion 25 extends inwardly upon the table surface to surround the inboard edge of the elongated aperture 24. The raised portion 25 in the preferred embodiment, comprises a molded strip of resilient material, such as rubber, which covers the edges of the table, and projects above the horizontal table surface a given distance.

This resilient strip performs several important functions. First of all it forms a protective barrier to prevent the sides of the table from becoming scratched or dented. It also creates a continuous raised barrier that will prevent spherical, and cylindrical objects, such a lead balls, and pistol and rifle cartridges, from rolling off the horizontal table surface. In addition, since the plurality of small recesses 23 are dimensioned to receive the stocks of rifles, which are supported therein; it provides a cushioned rest for the rifles, which will not mar their finish.

Turning now to the elongated aperture 24, this structural feature is designed and dimensioned to act as a carrying handle for transporting the table to and from its point of use. With this in mind, it should be obvious why the continuous resilient strip extends inwardly on the table surface, and places the aperture 24 outside of the area encompassed by the strip.

Figure 3:
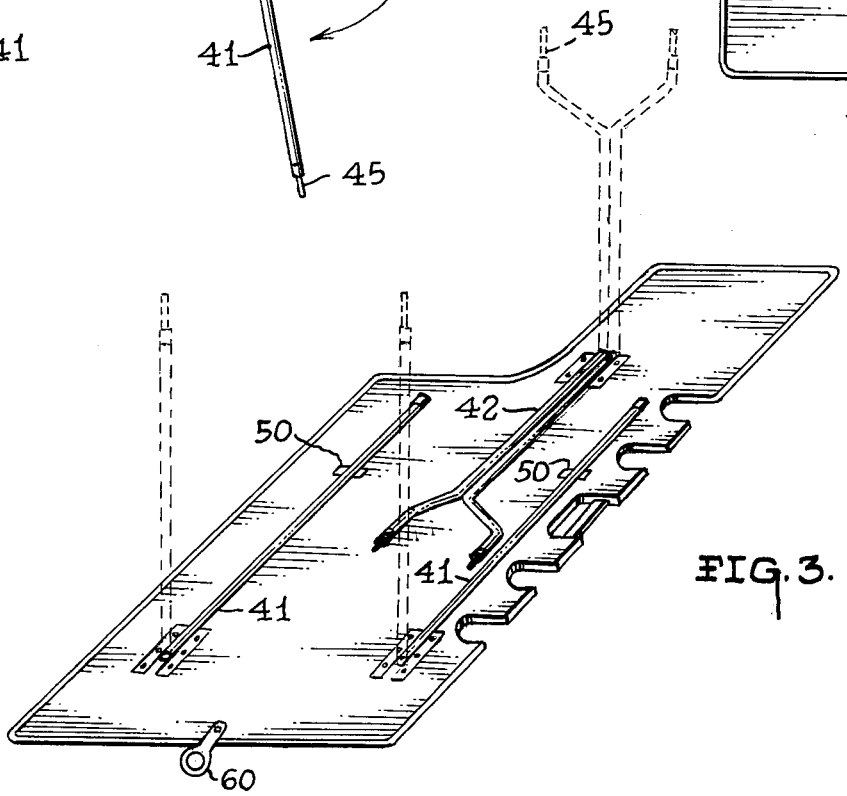
FIG. 3 is a bottom view of the table, with the legs folded in the stored position.

Referring now to FIG. 3, it can be seen that the plurality of collapsible, pivoted vertical support members 40 comprise a pair of tubular steel legs 41, disposed on the forward end of the table, and bifurcated tubular steel legs 42, disposed on the rearward end of the table. All of the vertical support members 40, are pivotally connected to the underside of the table, and provided with suitable means for locking them in their extended position, in any one of a number of well recognized manners. In addition, the underside of the table is further provided with spring loaded holding clamps 50, for retaining the vertical support members in their collapsed and stored position. All of the support members 40, are further provided with retractable members 45, which can be adjusted and locked, to vary the length of each of the support members, when the shooting bench is employed on uneven terrain, so that the top of the table will always be level, regardless of where the table is used.

The final structural feature of note is a pivoted ring element 60, which is disposed on the forward end of the end of the underside of the table. This ring element 60 is adapted to extend beyond the forward edge of the table, and provide a means to vertically suspend the shooting table for storage. When the table is in actual use, the ring 60, may be pivoted to a position underneath the table, so that it is out of the way.

It is should be appreciated by now, that a shooters table constructed in accordance with the above teachings will provide a lightweight, stable, horizontal shooting platforms, which allows the user to fire his weapon, in the exact position that they would encounter in the field, due to the enlarged recess at the rearward corner of the table. This recess permits the user to distribute the weight of both arms along the table surface in their most natural position. Obviously, the position of the various recesses and aperture would be reversed for right handed and left handed shooters.

Having thereby described the subject matter of this invention; it should be obvious that many substitutions, modifications, and variations of the inventors are possible in light of the above teachings. It is therefore to be understood that the invention as taught and described is only to be limited to the extent of the breadth and scope of the appended claims.

I claim:

1. A new and improved construction for shooting tables comprising:

a generally elongated rectangular horizontal support surface having;

an enlarged recess formed therein;

at least one elongated aperture disposed proximate an edge of the support surface; wherein, the said at least one elongated aperture forms a carrying handle for said shooting table;

at least one smaller recess formed along an edge of the support surface wherein said at least one smaller recess is dimensioned to receive a firearm used in conjuction with the shooting table, whereby the firearm will be supported in a generally vertical position with respect to said shooting table;

a continuous raised portion extending around at least a substantial portion of the periphery of the support surface; whereby rounded objects placed on the support surface will be prevented from rolling off said support surface; and a plurality of vertical support members pivotally connected to the underside of the horizontal support surface.

2. An improved shooting table as in claim 1; wherein, said enlarged recess is arcuate in shape, and is formed on one corner of said elongated generally rectangular horizontal support surface.

3. An improved shooting table as in claim 1; wherein, said horizontal support surface is further provided with a plurality of recesses formed along one edge of the support surface.

4. An improved shooting table as in claim 1; wherein the said continuous raised portion projects a given distance above the horizontal support surface, and covers at least a substantial portion of the edges of the horizontal support surface.

5. An improved shooting table as in claim 1; wherein, said enlarged recess is dimensioned to accommodate a portion of the upper torso of a person using the shooting table.

6. An improved shooting table as in claim 1; wherein, all of the vertical support members are adjustable and collapsible.

* * * * *